US011486391B2

(12) United States Patent
Maurischat

(10) Patent No.: US 11,486,391 B2
(45) Date of Patent: Nov. 1, 2022

(54) METHOD AND SCREW SPINDLE PUMP FOR DELIVERING A GAS/LIQUID MIXTURE

(71) Applicant: LEISTRITZ PUMPEN GMBH, Nuremberg (DE)

(72) Inventor: Roland Maurischat, Nuremberg (DE)

(73) Assignee: LEISTRITZ PUMPEN GMBH, Nuremberg (DE)

( * ) Notice: Subject to any disclaimer, the term of this patent is extended or adjusted under 35 U.S.C. 154(b) by 0 days.

(21) Appl. No.: 17/395,740

(22) Filed: Aug. 6, 2021

(65) Prior Publication Data

US 2022/0065247 A1 Mar. 3, 2022

(30) Foreign Application Priority Data

Aug. 27, 2020 (DE) ..... 10 2020 122 460.5

(51) Int. Cl.
*F04C 2/16* (2006.01)
*F04C 2/08* (2006.01)

(52) U.S. Cl.
CPC ..... *F04C 2/16* (2013.01); *F04C 2/084* (2013.01); *F04C 2210/24* (2013.01);
(Continued)

(58) Field of Classification Search
CPC .. F04C 2/084; F04C 2/16; F04C 2/165; F04C 18/084; F04C 18/16; F04C 18/165;
(Continued)

(56) References Cited

U.S. PATENT DOCUMENTS 2,287,716 A * 6/1942 Whitfield ..... F01C 20/14 277/423
2,511,878 A * 6/1950 Rathman ..... F04C 2/084 418/201.1

(Continued)

FOREIGN PATENT DOCUMENTS

DE 4316735 A1 11/1994
DE 4316735 C2 1/1996

(Continued)

OTHER PUBLICATIONS

German Office Action dated Jul. 26, 2021, DE 10 2020 122 460.5, 7 Pages.

(Continued)

*Primary Examiner* — Laert Dounis
(74) *Attorney, Agent, or Firm* — Lucas & Mercanti, LLP; Klaus P. Stoffel

(57) ABSTRACT

Method for delivering a gas/liquid mixture fluid via a screw spindle pump that has a housing in which a drive spindle and a running spindle are accommodated. The spindles delimit together with the housing multiple pump chambers. A respective one of the pump chambers that is initially open toward the respective fluid inlet is closed off. The resulting closed-off pump chamber is moved axially toward the fluid outlet and, there, upon attainment of an opening rotation angle, is opened toward the fluid outlet. The drive spindle is driven so that the pressure in the respective pump chamber prior to and/or upon attainment of the opening rotation angle is increased in relation to the suction pressure of the screw spindle pump by at most 20% or by at most 10% of a difference in pressure between the suction pressure and the pressure in the region of the fluid outlet.

10 Claims, 4 Drawing Sheets

(52) U.S. Cl.
CPC .... *F04C 2250/20* (2013.01); *F04C 2270/052* (2013.01); *F04C 2270/054* (2013.01)

(58) Field of Classification Search
CPC .... F04C 2210/24; F04C 2270/05–0545; F04C 2250/20; F01C 1/084; F01C 1/16; F01C 1/165
See application file for complete search history.

(56) References Cited

U.S. PATENT DOCUMENTS

| | | | | |
|---|---|---|---|---|
| 3,945,216 | A * | 3/1976 | Schibbye | F04C 18/16 62/84 |
| 5,624,249 | A | 4/1997 | Rohlfing | |
| 6,719,548 | B1 * | 4/2004 | Heizer | F01C 1/16 418/201.3 |
| 7,862,315 | B2 | 1/2011 | Rohlfing et al. | |
| 9,765,776 | B2 | 9/2017 | Metz | |
| 2006/0263230 | A1 * | 11/2006 | Swartzlander | F04C 18/16 418/206.1 |

FOREIGN PATENT DOCUMENTS

| | | | |
|---|---|---|---|
| DE | 69129037 | T2 | 7/1998 |
| DE | 102005025816 | A1 | 12/2006 |
| DE | 102011101648 | A1 | 11/2012 |
| EP | 0496170 | A2 | 7/1992 |
| GB | 448235 | A * | 6/1936 |

OTHER PUBLICATIONS

Indian Patent Office issued an Examination Report dated Apr. 20, 2022 regarding parallel Indian Patent Application No. 202144037313:, 5 Pages.

* cited by examiner

METHOD AND SCREW SPINDLE PUMP FOR DELIVERING A GAS/LIQUID MIXTURE

CROSS-REFERENCE TO RELATED APPLICATIONS

The present application claims priority of DE 10 2020 122 460.5, filed Aug. 27, 2020, the priority of this application is hereby claimed, and this application is incorporated herein by reference.

BACKGROUND OF THE INVENTION

The invention relates to a method for delivering a fluid which is a gas/liquid mixture by way of a screw spindle pump, said screw spindle pump having a housing which forms at least one fluid inlet and one fluid outlet and in which at least one drive spindle and at least one running spindle, coupled in terms of rotation to the latter, of the screw spindle pump are accommodated, which spindles, in each rotation position of the drive spindle, delimit together with the housing multiple pump chambers, wherein the drive spindle is rotated by a drive in a drive direction, whereby a respective one of the pump chambers that is initially open toward the respective fluid inlet is closed off, the resulting closed-off pump chamber is moved axially toward the fluid outlet and, there, upon attainment of an opening rotation angle, is opened toward the fluid outlet. The invention also relates to a screw spindle pump.

Screw spindle pumps are used in numerous areas for delivering fluids. Here, purely liquid media, for example petroleum or crude oil, may be delivered. Mixtures of gases and liquids, for example of crude oil and natural gas, which are to be delivered are commonly present, however.

In conventional screw spindle pumps, multiple chambers are formed in an axial direction, between which chambers, in the case of delivery of fluid only, the pressure increases at least approximately linearly from a pressure at the fluid inlet to a pressure at the fluid outlet. In this case, relatively large differences in pressure between the fluid inlet and the fluid outlet of for example 5 to 50 bar or even larger differences in pressure are commonly used.

If a gas/liquid mixture with a relatively large gas proportion is delivered by a conventional screw spindle pump, there is a resulting hyperbolic buildup of pressure, since, owing to the compressibility of the gas proportion and to the constantly present radial and axial gaps between the individual spindles or between the spindles and the housing, liquid can flow from chambers with a relatively high pressure back into the preceding chambers, whereby the gas present there is compressed and there is a resulting increase in pressure. A disadvantage here is that the fluid is initially delivered against a relatively large pressure gradient and then at least partially flows back into a region of relatively low pressure. This typically results in a power requirement for the pump that is approximately independent of the gas proportion and based on delivery of liquid only.

For compression of gases with very low liquid content, approaches which are more efficient in principle are known. In this regard, use may be made of screw spindle pumps whose spindles have a variable screw lead, in order for the gas to be compressed directly through reduction of the chamber volume. Also known are gas compressors which, by way of screw spindle pumps, firstly deliver the gas against a fixed wall and thereby compress said gas, wherein the gas can exit the delivery chamber only after the required compression has been achieved.

A disadvantage of the stated approaches for efficient gas compression is that the gas compression is in each case realized by changing the geometry of a compressor chamber. Consequently, said approaches are not however usable for applications in which, at least temporarily, a large liquid proportion, in particular a liquid proportion of close to 100%, can occur. This is so because in this case, for reduction of the compressor chamber, the fluid would have to be compressed, which would require forces which typically cannot be applied by corresponding compressors or which can lead to the compressor being damaged.

SUMMARY OF THE INVENTION

The invention is therefore based on the object of improving the efficiency of a delivery of a gas/liquid mixture, wherein delivery, at least temporarily, also of mixtures with a large liquid proportion is to remain possible at the same time.

The object is achieved by a method of the type mentioned in the introduction, wherein the drive spindle is driven in such a manner that, for a given pump geometry of the screw spindle pump, the pressure in the respective pump chamber prior to and/or upon attainment of the opening rotation angle is increased in relation to the suction pressure of the screw spindle pump, which prevails in the region of the respective fluid inlet, by at most 20% or by at most 10% of a difference in pressure between the suction pressure and the pressure in the region of the fluid outlet. In particular, the pressure in the respective pump chamber prior to and/or upon attainment of the opening rotation angle can be above the suction pressure by at most 5% of the difference in pressure.

As explained above, the hyperbolic increase in pressure during delivery of a gas/liquid mixture in conventional screw spindle pumps results from the backflow of liquid through remaining gaps between the pump chambers. It has been found that, through suitable adaptation of the pump geometry and/or of the rotational speed of the pump, said backflow of the liquid can be reduced to such an extent that the major part of the pressure increase generated by the screw spindle pump occurs only after the opening of the respective pump chamber toward the fluid outlet. At sufficient rotational speed or with a suitable pump geometry, it may be assumed at least approximately here that the liquid already situated in the region of the fluid outlet, owing to its inertia, substantially does not flow into the opening pump chamber but rather can be regarded as a rigid wall against which the gas/liquid mixture with an especially large gas proportion is compressed. As long as the fluid in the opening chamber has a large gas proportion, a similar level of high efficiency is consequently achieved in the method according to the invention as with gas compressors which deliver gas against a rigid wall of the housing.

If, by contrast, the opening pump chamber is filled with a gas/liquid mixture with a very large liquid proportion or even exclusively with liquid, the liquid column in the fluid outlet region can consequently be transported onward, which results in substantially the same behavior as in the use of the screw spindle pump for transporting pure liquids. Although the optimization of the operating parameter for achieving the above-described properties for large gas proportions can lead to a slight drop in efficiency for large liquid proportions of the gas/liquid mixture, if sufficiently large gas proportions occur sufficiently frequently, a considerably energy saving is achieved since the power requirement for these periods of time is considerably below that of conventional screw spindle pumps.

The reduced power or energy requirement in the method according to the invention in comparison with conventional screw spindle pumps results on the one hand from it being possible to largely avoid the above-mentioned backflow of liquid through relatively narrow gaps of the pump, whereby losses resulting therefrom can be avoided. A lower power requirement also results however directly from consideration of the required torques. In the above-described procedure, in which a compression of gas is approximately realized against a stationary liquid wall, the pressure in the increasingly opening pump chamber, assuming isothermal compression, increases linearly with the angle of rotation of the respective spindle. At the same time, the extent of the pump chamber in a circumferential direction is reduced with the angle of rotation as the opening increases. Thus, the torque-effective chamber surface area decreases approximately linearly with the angle of rotation during the opening of the chamber. These factors together lead to the torque contribution required for the compression in the respective pump chamber being halved in comparison with a torque calculation which is based on a pressure in the pump chamber that is already significantly increased during the opening, whereby it is also the case that the required drive power can be correspondingly reduced.

For realizing the method according to the invention, it can be sufficient to use rotational speeds which are sufficiently high in the case of screw spindles pumps known per se, since, in this case, for a given backflow volume of the liquid per unit time, less liquid flows back into the preceding pump chambers overall and consequently a smaller increase in pressure is the result. Realization of the method according to the invention solely through an increase in rotational speed can however be problematic with regard to the required power and thus the dimensioning of the drive or with regard to the mechanical loading and the level of wear of the pump. In advantageous configurations of the method according to the invention, use may therefore be made of a correspondingly adapted pump geometry, in particular with regard to gap dimensions or chamber volumes, whereby the use of excessively high rotational speeds for realizing the method according to the invention can be avoided.

Prior to the attainment of the opening rotation angle, the respective pump chamber is, with the exception of tolerance-induced deviations, sealed off identically with respect to the pump chamber which is adjacent in the direction of the fluid inlet and with respect to the fluid outlet. Thus, an exchange of fluid, in both directions, is possible substantially only via the radial and axial gaps of the pump. The opening of the pump chamber toward the fluid outlet upon attainment of the opening rotation angle results from the fact that the thread of the respective spindle forming the pump chamber, or the wall delimiting the respective thread toward the fluid outlet, ends at a particular angular position, which depends on the rotation angle of the spindle. This leads to there being a resulting gap in a circumferential direction between said wall and another one of the spindles, which delimits the pump chamber, from a certain limit angle. The pump chamber is open toward the fluid outlet by way of said gap in the circumferential direction. The opening rotation angle can thus be defined as that angle from which, in addition to the axial and radial gaps, there is a resulting gap in a circumferential direction.

Alternatively, the opening rotation angle could be defined via the flow cross section which allows an exchange of fluid between pump chamber and fluid outlet. If said flow cross section is enlarged by 50% or 100% or 200% in relation to the closed-off pump chamber, the attainment of this limit may be defined as the attainment of the opening rotation angle.

The screw spindle pump according to the invention may have one or two channels, that is to say have one or two fluid inlets situated opposite one another in an axial direction. The screw spindle pump may have two, three or more spindles. Individual spindles may for example be of two-start design. Individual or all the spindles may however also be of one-start or three-start design or else have more starts.

The screw profiles of the respective drive spindle and running spindle may be selected in such a way that the mean value of the number of pump chambers per drive spindle and running spindle that are closed off both with respect to the fluid inlet and with respect to the fluid outlet is at most 1.5 over a rotation angle of the drive spindle of 360°. If, for example, exactly one drive spindle and exactly one running spindle are used, as a mean, at most 3 pump chambers may be completely closed off. The mean value may be determined for example by integrating over the angle of 360° the number of chambers which are closed for a respective rotation angle of the drive spindle and then dividing the result by 360°. If the rotational speed is constant, this corresponds to an integration of the number of simultaneously closed pump chambers over a period of rotation of the drive spindle and a division by the period of rotation.

While in the case of screw spindle pumps for liquid delivery use of a relatively large number of pump chambers following one after the other axially is typically desired, it has been found in the context of the invention that using relatively few chambers which are maximally closed off simultaneously with reduced length of the screw profile results in a larger volume for the individual pump chambers. The same amount of liquid flowing back through pump gaps thus leads to a smaller relative change in the volume remaining for the gas proportion, which results in less gas compression and thus a smaller increase in pressure prior to the opening of the pump chamber toward the fluid outlet. The desired effect can thus already be achieved at considerably lower rotational speeds than in cases in which use is made of a relatively large number of pump chambers following one after the other axially.

A lower limit for the maximum number of pump chambers which are closed off both with respect to the fluid inlet and with respect to the fluid outlet irrespective of the state of rotation results from the fact that, for each pair composed of a spindle and a fluid inlet, in at least one state of rotation, a pump chamber must be closed off both with respect to the fluid inlet and with respect to the fluid outlet, since otherwise, during a passage from a fluid inlet-side opening to a fluid outlet-side opening, the result would be brief opening of the pump chamber on both sides and thus a direct connection from fluid inlet and fluid outlet, which would lead to a very high level of undesired leakage of the pump.

In the context of the method, during at least one time interval, a gas/liquid mixture with a gas proportion of at least 90% may be delivered. Alternatively or additionally, in the context of the method, during at least one further time interval, a gas/liquid mixture with a liquid proportion of at least 70% may be delivered. The method according to the invention is particularly suitable if fluids having mixing ratios which differ greatly with respect to time are to be delivered. The reduction in the required power is particularly large for large gas proportions. Consequently, it is also possible in particular for gas proportions of more than 95% to be used. In comparison with gas compressors, however, fluids with a considerably larger liquid proportion can be transported. In particular, in the method according to the invention, use may be made of a screw spindle pump which, even for a liquid proportion of 90% or 100% in the gas/liquid mixture, still allows the gas/liquid mixture to be delivered.

The pump geometry and the rotational speed of the screw spindle pump used may be selected in such a way that the axial speed of the respective pump chamber during the axial movement toward the fluid outlet is at least 4 m/s. The axial speed depends both on the lead of the thread or of the threads of the respective spindle and on the rotational speed. In other words, high axial speeds can be achieved by high rotational speeds and/or large leads or relatively long pump chambers. Large leads or long pump chambers lead in turn to large chamber volumes and thus to a reduction in the influence of back-flowing liquid on the pressure in the pump chamber.

The pump geometry of the screw spindle pump used may be selected in such a way that the inner diameter of the screw profile of the drive spindle or of at least one of the drive spindles and/or of the running spindle or of at least one of the running spindles is less than 0.7 times the outer diameter of the respective screw profile. In particular, this relationship may hold for all the drive spindles and running spindles. In other words, the minimum extent of the core of the screw profile in a radial direction of the respective spindle is less than 0.7 times the maximum extent of the screw profile. This results in the difference between the inner and outer diameters and thus the pump chamber volume being relatively large, whereby, as already mentioned above, the same amount of back-flowing liquid leads to a smaller increase in pressure.

The pump geometry of the screw spindle pump used may be selected in such a way that the mean circumferential gap between the outer edge of the screw profile of the drive spindle or of at least one of the drive spindles and/or of the running spindle or of at least one of the running spindles and the housing is less than 0.002 times the outer diameter of the respective screw profile. The mean value of the width of the circumferential gap along the length of the circumferential gap may be regarded in particular as the mean circumferential gap. Additionally, a mean determination can be realized over a rotation of the drive spindle, in order to take into account variations of the circumferential gap with the rotation of the spindles. In other words, the mean width of the circumferential gap between a spindle and the housing is preferably less than 2 pm per millimeter of the outer diameter of the respective spindle. The use of small circumferential gaps allows the leakage of the pump, that is to say the amount of the fluid flowing back into the pump chamber, to be reduced, whereby in turn the increase in pressure in the pump chamber can be reduced up to the opening toward the fluid outlet.

The pump geometry and the rotational speed of the screw spindle pump used may be selected in such a way that the circumferential speed at the profile outer diameter of the drive spindle or of at least one of the drive spindles and/or of the running spindle or of at least one of the running spindles is at least 15 m/s. This may hold in particular for all the drive spindles and running spindles. The circumferential speed can be calculated as the product of the profile outer diameter, the rotational speed and pi. Consequently, the stated condition can be achieved in particular with use of high rotational speeds or large profile outer diameters. Relatively small profile inner diameters tend to lead to an enlargement of the volume of the respective pump chamber, whereby, as mentioned above, the influence of back-flowing liquid on the pressure in the pump chamber can be reduced.

Beside the method according to the invention, the invention relates to a screw spindle pump for delivering a fluid which is a gas/liquid mixture, wherein the screw spindle pump has a housing which forms at least one fluid inlet and one fluid outlet and in which at least one drive spindle and at least one running spindle, coupled in terms of rotation to the latter, of the screw spindle pump are accommodated, which spindles, in each rotation position of the drive spindle, delimit together with the housing multiple pump chambers, wherein the screw spindle pump has a drive which is configured to rotate the drive spindle in a drive direction, whereby a respective one of the pump chambers that is initially open toward the respective fluid inlet is closed off, the resulting closed-off pump chamber is moved axially toward the fluid outlet and, there, upon attainment of an opening rotation angle, is opened toward the fluid outlet, wherein the screw profiles of the respective drive spindle and running spindle are selected in such a way that the mean value of the number of pump chambers per drive spindle and running spindle that are closed off both with respect to the fluid inlet and with respect to the fluid outlet is at most 1.5 over a rotation angle of the drive spindle of 360°.

Details regarding such a pump geometry have already been mentioned for the method according to the invention. The screw spindle pump may be configured in particular for carrying out the method according to the invention. Irrespective of this, features mentioned for the method according to the invention with the advantages mentioned may be transferred to the screw spindle pump according to the invention, and vice versa.

In particular, the drive or a control device controlling the drive may be configured in such a way that, in at least one operating state of the screw spindle pump, the drive spindle is operated at least at a minimum rotational speed at which the pressure in the respective pump chamber prior to and/or upon attainment of the opening rotation angle is increased in relation to the suction pressure of the screw spindle pump, which prevails in the region of the respective fluid inlet, by at most 20% or by at most 10% of a difference in pressure between the suction pressure and the pressure in the region of the fluid outlet.

Additionally or alternatively, by way of corresponding configurations of the drive or of the control device, it is also possible for the rotational speed-dependent conditions stated above for the method according to the invention to be satisfied in the operating state.

The inner diameter of the screw profile of the drive spindle or of at least one of the drive spindles and/or of the running spindle or of at least one of the running spindles may be less than 0.7 times the outer diameter of the respective screw profile. Additionally or alternatively, the mean circumferential gap between the outer edge of the screw profile of the drive spindle or of at least one of the drive spindles and/or of the running spindle or of at least one of the running spindles and the housing may be less than 0.002 times the outer diameter of the respective screw profile. These features and the advantages thereof have already been discussed for the method according to the invention.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
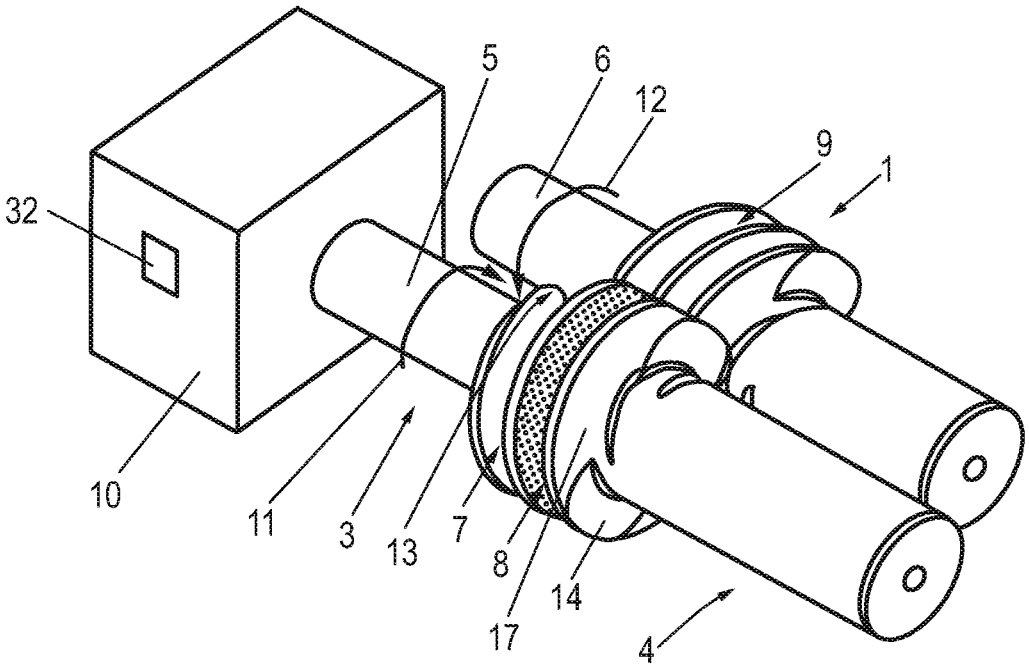
FIGS. 1 to 3 show various detail views of an exemplary embodiment of a screw spindle pump according to the invention, by way of which an exemplary embodiment of the method according to the invention is carried out.
Figure 2:
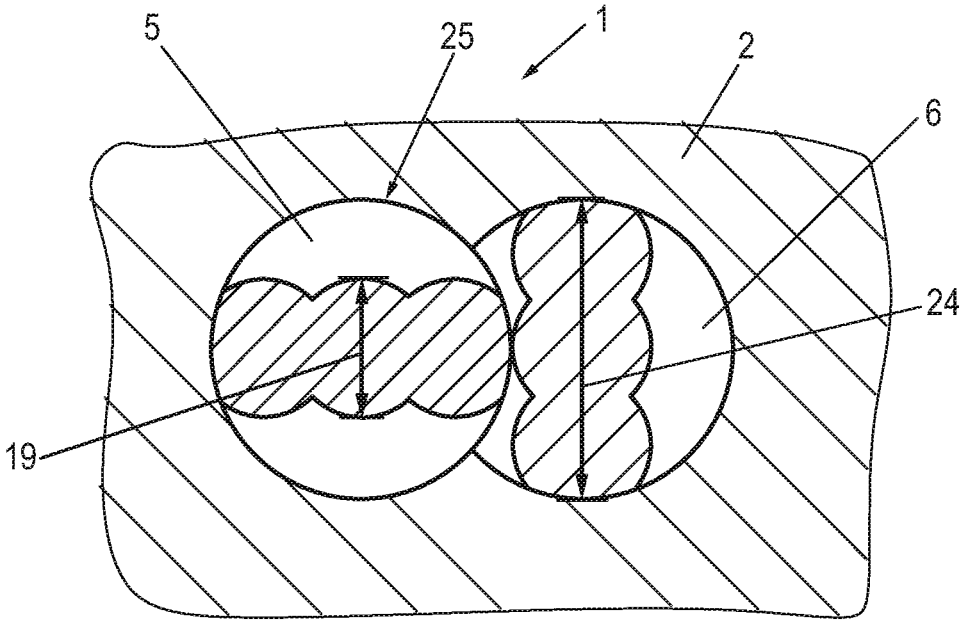
Figure 3:
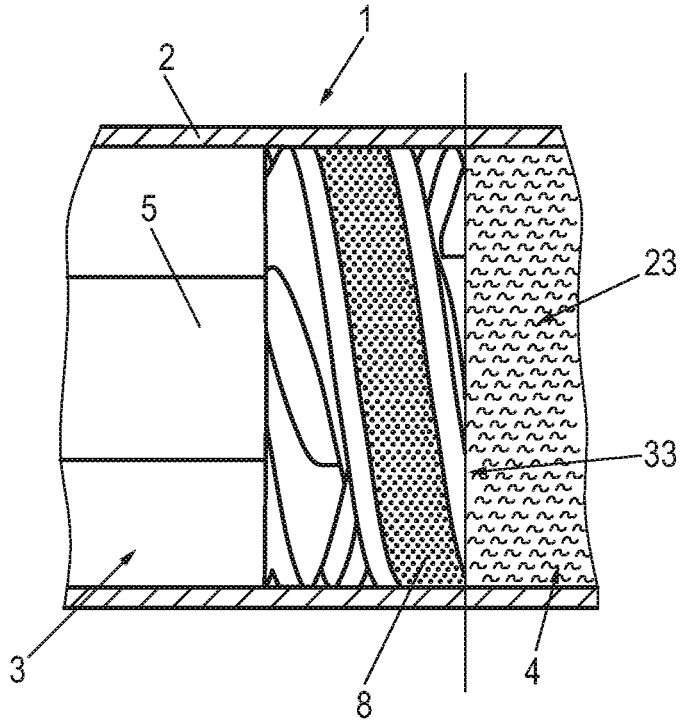

FIGS. 1, 2 and 3 show various detail views of a screw spindle pump which serves for delivery of a fluid that is a gas/liquid mixture. Here, FIG. 1 schematically shows a perspective view of the drive spindle 5 and the running spindle 6 of the screw spindle pump 1, wherein, for reasons of clarity, the housing 2 is not illustrated in FIG. 1. FIG. 1 illustrates in particular the shape of the screw profiles of the drive spindle 5 and the running spindle 6, and also the interengagement thereof.

FIG. 2 shows a face section, in which there can be seen in particular the interaction of the drive spindle 5 and the running spindle 6 with the housing 2 for forming multiple separate pump chambers 7, 8, 9, which are in turn indicated in FIG. 1 since they extend beyond the section plane shown in FIG. 2.

For illustrating the transport of fluid from a fluid inlet 3, formed by the housing 2, to a fluid outlet 4, formed by the housing 2, by way of operation of the drive spindle 5 and the running spindle 6, FIG. 3 moreover illustrates a section perpendicular to the axial direction and to the plane in which the axes of rotation of the drive spindle 5 and the running spindle 6 lie.

The running spindle 6 is coupled in terms of rotation to the drive spindle 5 by a coupling device (not illustrated), wherein a 1:1 transmission ratio is assumed in the example.

Consequently, when the drive shaft 5 is driven by the drive 10 in the drive direction 11, the running spindle 6 is rotated in the opposite direction of rotation 12 and at the same rotational speed. The rotational speed of the drive spindle 5 and thus also of the running spindle 6 can be predefined by a control device 32 of the drive 10.

The interengagement of the screw profiles of the drive spindle 5 and the running spindle 6 results in the fluid situated in the housing 2 being received in multiple pump chambers 7, 8, 9 which are separated from one another. The separation or closure of the pump chambers 7, 8, 9, owing to the radial gap 25 between housing 2 and drive spindle 5 or running spindle 6 and owing to remaining axial gaps between the interengaging screw profiles, is not completely tight, but rather allows a certain exchange of fluid between the pump chambers 7, 8, 9, which may also be regarded as leakage.

In the rotation position shown in FIG. 1 of the drive spindle 5 and of the running spindle 6, the pump chamber 7 is open toward the fluid inlet 3 since the free end 13 of the wall 17 of the screw thread of the drive spindle 5 is directed upward in FIG. 1, whereby a gap remains between said free end 13 and the running spindle 6 in a circumferential direction, through which the fluid can flow between the pump chamber 7 and the fluid inlet 3. Correspondingly, the pump chamber 8, which is highlighted by dots on its outer surface in FIG. 1, is open toward the fluid outlet 4, since the free end 14 of the wall 17 delimiting said pump chamber, owing to the rotation position, is in turn spaced apart from the running spindle 6 and thus forms a radial gap through which the fluid can flow. The pump chamber 9 is closed off both with respect to the fluid inlet 3 and with respect to the fluid outlet 4.

When the drive spindle 5 is driven in the drive direction 11, firstly the free end 13 of the wall 17 is moved to the running bobbin 6 and the initially open pump chamber 7 is thereby closed off. Further rotation then leads to the displacement of the closed-off pump chamber toward the fluid outlet 4. Upon attainment of a certain opening rotation angle, the pump chamber is then opened toward the fluid outlet 4, wherein, upon further rotation through 90° after attainment of the opening rotation angle, the result is the arrangement as is illustrated for the pump chamber 8 in FIG. 1, in which there is already a resulting gap in a circumferential direction that has a certain width between the free end 14 and the running bobbin 6.

The procedure described for transporting liquids or else gas/liquid mixtures through a screw spindle pump 1 is known per se in the prior art. Consequently, further details and possible modifications, for example the use of multiple fluid inlets or multiple running spindles, shall not be discussed in any more detail.

Screw spindle pumps are commonly used in areas in which significant differences in pressure of for example 5 to 50 bar between the fluid inlet 3 and the fluid outlet 4 can occur. If, in this case, a gas/liquid mixture is delivered, the result here is a compression of the gas proportion. Conventional screw spindle pumps are in this case designed in such a way that a relatively large number of pump chambers closed off with respect to one another, for example five to ten pump chambers closed off with respect to one another, in an axial direction is the result. The compression of the gas is realized here in the individual pump chambers in that liquid flows back from the pump chamber which is in each case adjacent in the direction of the fluid outlet, in which pump chamber a relatively high pressure already prevails, and thereby reduces the volume in the pump chamber that is available for the gas, which leads to compression of the gas. As already discussed in the general part of the description, such a compression of the gas proportion does however lead to the power requirement of the screw spindle pump, in the case of large gas proportions, being relatively high, specifically approximately as high as in the case of liquid delivery.

It has been found that the power consumption in the case of delivery of gas/liquid mixtures with a large gas proportion can be reduced significantly if gas compression by such a backflow of liquid is largely avoided and thus the compression of the gas and thus also the increase of pressure in the pump chambers 7, 8, 9 is realized substantially only after the pump chamber 8 is opened toward the fluid outlet 4. This is achieved in the screw spindle pump illustrated in FIGS. 1 to 3 through selection of a suitable pump geometry, on the one hand, and through use of a sufficiently high rotational speed, on the other hand. In this way, it can be achieved that, in relation to the suction pressure of the screw spindle pump 1, which prevails in the region of the fluid inlet 3, the pressure in the respective pump chamber 7, 8, 9 prior to and/or upon attainment of the opening rotation angle is increased by only a few percent of the difference in pressure between the suction pressure and the pressure in the region of the fluid outlet 4. For example, the pressure in the pump chamber when being opened can be above the suction pressure by at most 10% or at most 20% of the difference in pressure.

If it is then approximately assumed that only a negligible part of the fluid 23, in particular of the liquid proportion of the fluid 23, flows from the region of the fluid outlet 4 back into the open pump chamber 8, then this corresponds approximately to a compression of the fluid in the chamber 8 against a stationary fluid wall 33 in the region of the fluid outlet 4. The rotation of the drive spindle 5 in the drive direction 11, as will be explained in more detail below with reference to FIGS. 4 to 7, leads in this case to a reduction in the volume of the pump chamber 8 and thus to a compression of the gas proportion and an increase in pressure. It is thus possible to achieve degrees of efficiency similar to those in the case of gas compressors, which implement compression of gas through delivery against a rigid wall. At the same time, however, liquids with a large liquid proportion can still be delivered, which would not be possible with conventional gas compressors.

Figure 4:
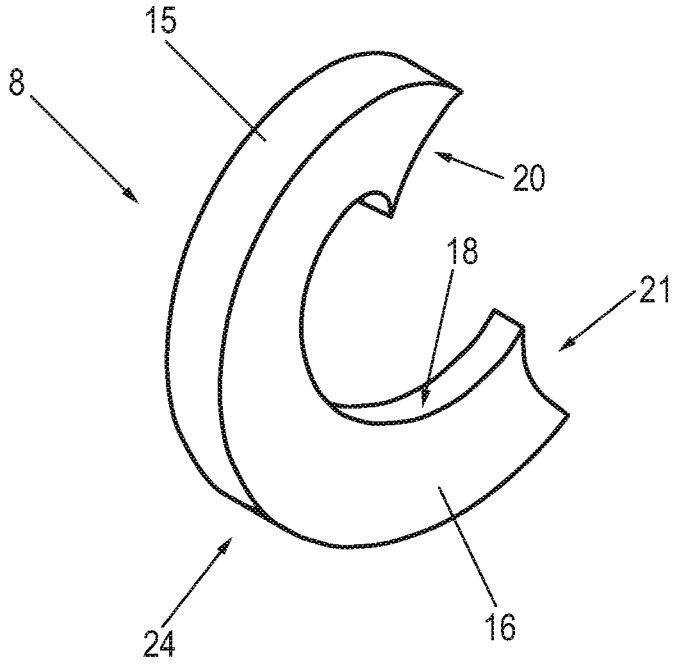
FIGS. 4 to 7 show an illustration of the change in the geometry of the pump chamber when being opened toward the fluid outlet in the exemplary embodiment of the method according to the invention.

At a point in time prior to the point in time shown in FIG. 1, at which the drive spindle 5, in comparison with the position illustrated in FIG. 1, is rotated through 90° counter to the drive direction 11, the the pump chamber 8 is just closed off and has the shape shown in FIG. 4. This position corresponds to the opening rotation angle, since an infinitesimal rotation in the drive direction 11 from this position opens the pump chamber 8.

With the pump chamber 8 closed, the outer surface 24 of the pump chamber 8 is delimited by the housing 2, the inner surface 18 is delimited by the inner diameter 19 of the drive spindle 5, the face surface 16 is delimited by the wall 17 of the thread of the screw spindle 5 forming the pump chamber 8, and the concealed surfaces 20, 21 are delimited by the running spindle 6.

Figure 5:
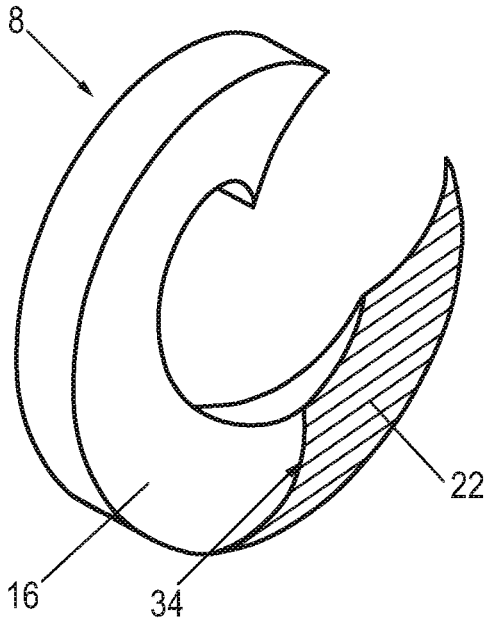

When the drive shaft 5 is rotated in the drive direction 11, the pump chamber 8 is opened in that the free end with respect to the pump chamber 8 is displaced into the position 34 shown in FIG. 5. Consequently, the wall 17 no longer delimits the pump chamber toward the fluid outlet 4 over the entire surface of the pump chamber, but rather the surface portion 22 is exposed or is delimited by the fluid wall 33. If the fluid wall 33, as explained above, is approximately assumed to be rigid, this leads to a compression of the gas in the pump chamber 8 due to a reduction in the volume of the pump chamber 8.

Figure 6:
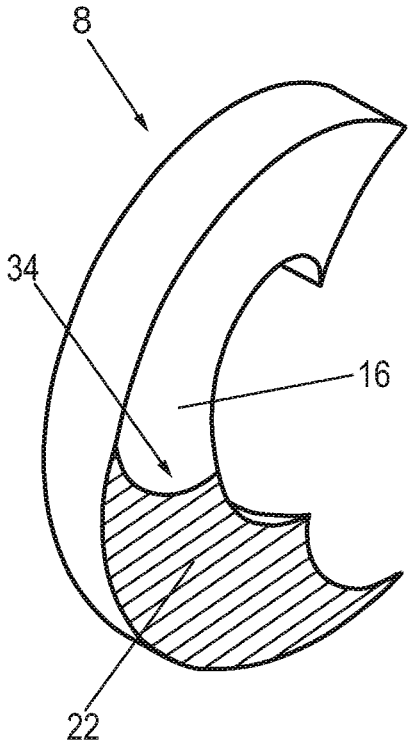

Further rotation of the drive spindle 5 in the drive direction 11 through 90° leads to the shape of the pump chamber 8 illustrated in FIG. 6 and thus to a further compression.

Figure 7:
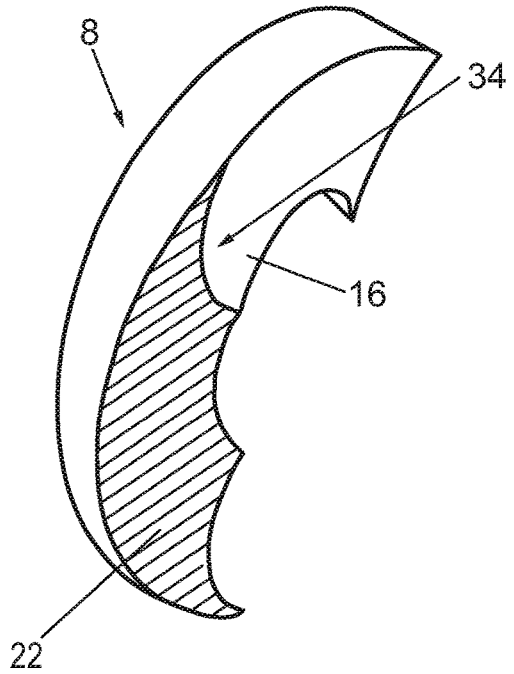

FIG. 7 shows a further state of rotation with even greater compression.

The behavior described could in principle also be achieved with conventional pump geometries solely through selection of a sufficiently high rotational speed, wherein, under some circumstances, the required high rotational speeds can lead to high loading or a high level of wear of the pump. The screw spindle pump 1 therefore uses a specific pump geometry, with which the described behavior can be achieved even at relatively low rotational speeds, for example even at 1000 revolutions per minute or 1800 revolutions per minute. In particular, instead of the use of a multiplicity of pump chambers which follow one after the other in an axial direction, said use being customary in screw spindle pumps, relatively few pump chambers or turns of the screw threads of the drive spindle 5 and of the running spindle 6 are used. In the rotation position shown in FIG. 1, only exactly one pump chamber 9 is closed off both with respect to the fluid inlet 3 and with respect to the fluid outlet 4. Dependent on the specific geometrical configuration of the free ends 13, 14 of the wall 17, the result in this case, in the example shown, can be at most one or at most two simultaneously closed-off pump chambers irrespective of the state of rotation of the drive spindle 5 and of the running spindle 6. The suitable maximum number of pump chambers which can be simultaneously closed off scales with the number of fluid inlets, so that, in the case of a two-channel pump, typically twice as many pump chambers can be simultaneously closed off than in the case of a single-channel pump. Moreover, the maximum number of pump chambers which are simultaneously closed off can scale with the number of running spindles and/or drive spindles used.

The use of relatively few pump chambers following one after the other in an axial direction and thus of relatively few pump chambers which can be maximally closed off simultaneously allows axially relatively long pump chambers and thus pump chambers with a relatively large volume to be realized, whereby the same amount of a liquid flowing back into the pump chamber through gaps has a smaller influence on the pressure in the pump chamber.

Furthermore, for achieving a large volume of the pump chambers 7 to 9, it is advantageous for the inner diameter 19 of the screw profile of the drive and running spindles 5, 6, as can be clearly seen in particular in FIG. 2, to be significantly smaller, smaller approximately by a factor of 2 in the example, than the outer diameter 24 of the respective spindle.

For the purpose of avoiding excessive compression and thus an excessive increase in pressure prior to the opening of the respective pump chamber 7, 8, 9, it is also expedient to minimize the backflow of liquid into the respective pump chamber through use of narrow gaps in the screw spindle pump 1. In particular, the radial gap 25 between the housing 2 and the respective outer diameter 24 of the drive spindle 5 or of the running spindle 6 can be narrower than two thousandths of the outer diameter 24.

As explained, the pump geometry of the screw spindle pump 1 and a sufficiently high rotational speed interact to achieve the effects mentioned above. Here, for a given pump geometry, the rotational speed should be selected in such a way that the axial speed of the movement of the respective pump chamber 7, 8, 9 toward the fluid outlet 4 is at least four meters per second, and/or that the circumferential speed at the profile outer diameter 24 of the drive spindle 5 or the running spindle 6 is at least 15 meters per second.

Figure 8:
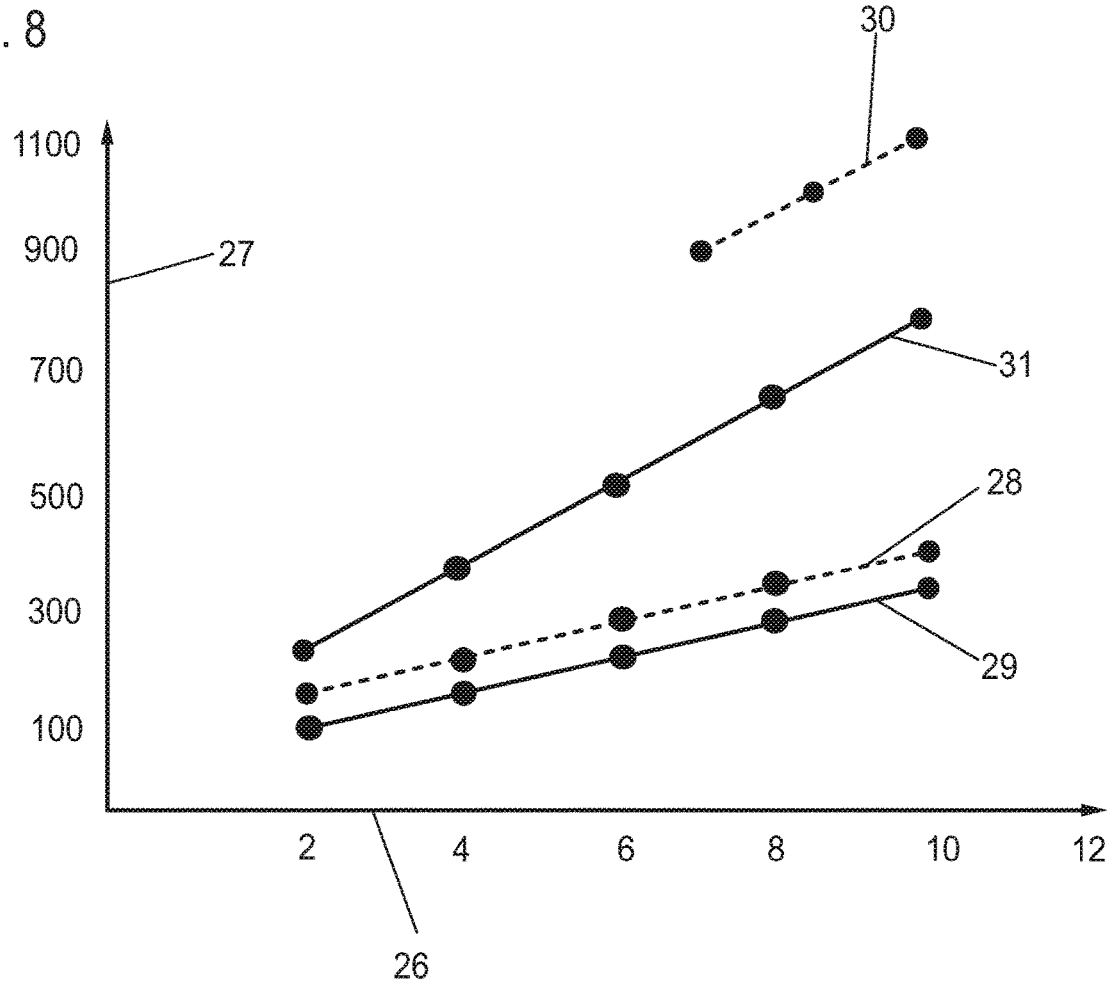
FIG. 8 shows test measurements concerning the effect of large gas proportions on the required drive power.

FIG. 8 shows for test measurements on a prototype the relationship between the difference in pressure between the suction pressure of the screw spindle pump and the pressure in the region of the fluid outlet, which is plotted on the X-axis 26, and the drive power required for achieving said difference in pressure, which is indicated on the Y-axis. Here, the curves 28, 29 show this relationship for a rotational speed of 1000 revolutions per minute, wherein the relationship as per curve 28 is the result in the case of transport of liquid only and the relationship as per curve 29 is the result in the case of a gas proportion of 95% of the fluid delivered. As can be clearly seen in FIG. 8, the required drive powers in the two cases are very similar, that is to say, at a rotational speed of 1000 revolutions per minute, the prototype still exhibits the behavior of conventional screw spindle pumps.

The curves 30, 31 show the same relationship for a rotational speed of 1800 revolutions per minute. Here, the curve 30 relates to the transport of a pure liquid, and the curve 31 relates to the transport of a fluid with a gas proportion of 95%. Through selection of a sufficiently high rotational speed, it is achieved here that, in the case of a large gas proportion in the delivered fluid, during the opening of the respective pump chamber, the pressure therein is only slightly above the suction pressure, whereby considerably less drive power is required for delivered fluid with a large gas proportion than for delivery of liquids. In the example shown, approximately 25% less power is required for operating the screw spindle pump. As mentioned above, this effect can be achieved even at lower rotational speeds through suitable modification of the pump geometry.

While specific embodiments of the invention have been shown and described in detail to illustrate the inventive principles, it will be understood that the invention may be embodied otherwise without departing from such principles.

I claim:

1. A method for delivering a fluid which is a gas/liquid mixture by way of a screw spindle pump, said screw spindle pump having a housing which forms at least one fluid inlet and one fluid outlet and in which at least one drive spindle and at least one running spindle, coupled in terms of rotation to the latter, of the screw spindle pump are accommodated, which spindles, in each rotation position of the drive spindle, delimit together with the housing multiple pump chambers, wherein the drive spindle is rotated by a drive in a drive direction, whereby a respective one of the pump chambers that is initially open toward the respective fluid inlet is closed off, the resulting closed-off pump chamber is moved axially toward the fluid outlet and, there, upon attainment of an opening rotation angle, is opened toward the fluid outlet, wherein the drive spindle is driven in such a manner that, for a given pump geometry of the screw spindle pump, the pressure in the respective pump chamber prior to and/or upon attainment of the opening rotation angle is increased in relation to the suction pressure of the screw spindle pump, which prevails in the region of the respective fluid inlet, by at most 20% or by at most 10% of a difference in pressure between the suction pressure and the pressure in the region of the fluid outlet.

2. The method according to claim 1, wherein the screw profiles of the respective drive spindle and running spindle are selected in such a way that the mean value of the number of pump chambers per drive spindle and running spindle that are closed off both with respect to the fluid inlet and with respect to the fluid outlet is at most 1.5 over a rotation angle of the drive spindle of 360°.

3. The method according to claim 1, wherein, in the context of the method, during at least one time interval, a gas/liquid mixture with a gas proportion of at least 90% is delivered, and/or in that, in the context of the method, during at least one further time interval, a gas/liquid mixture with a liquid proportion of at least 70% is delivered.

4. The method according to claim 1, wherein the pump geometry and the rotational speed of the screw spindle pump used are selected in such a way that the axial speed of the respective pump chamber during the axial movement toward the fluid outlet is at least 4 m/s.

5. The method according to claim 1, wherein the pump geometry of the screw spindle pump used is selected in such a way that the inner diameter of the screw profile of the drive spindle or of at least one of the drive spindles and/or of the running spindle or of at least one of the running spindles is less than 0.7 times the outer diameter of the respective screw profile.

6. The method according to claim 1, wherein the pump geometry of the screw spindle pump used is selected in such a way that the mean circumferential gap between the outer edge of the screw profile of the drive spindle or of at least one of the drive spindles and/or of the running spindle or of at least one of the running spindles and the housing is less than 0.002 times the outer diameter of the respective screw profile.

7. The method according to claim 1, wherein the pump geometry and the rotational speed of the screw spindle pump used are selected in such a way that the circumferential speed at the profile outer diameter of the drive spindle or of at least one of the drive spindles and/or of the running spindle or of at least one of the running spindles is at least 15 m/s.

8. A screw spindle pump for delivering a fluid which is a gas/liquid mixture, wherein the screw spindle pump has a housing which forms at least one fluid inlet and one fluid outlet and in which at least one drive spindle and at least one running spindle, coupled in terms of rotation to the latter, of the screw spindle pump are accommodated, which spindles, in each rotation position of the drive spindle, delimit together with the housing multiple pump chambers, wherein the screw spindle pump has a drive which is configured to rotate the drive spindle in a drive direction, whereby a respective one of the pump chambers that is initially open toward the respective fluid inlet is closed off, the resulting closed-off pump chamber is moved axially toward the fluid outlet and, there, upon attainment of an opening rotation angle, is opened toward the fluid outlet, wherein the screw profiles of the respective drive spindle and running spindle are selected in such a way that the mean value of the number of pump chambers per drive spindle and running spindle that are closed off both with respect to the fluid inlet and with respect to the fluid outlet is at most 1.5 over a rotation angle of the drive spindle of 360°, wherein the drive or a control device controlling the drive may be configured in such a way that, in at least one operating state of the screw spindle pump, the drive spindle is operated at least at a minimum rotational speed at which the pressure in the respective pump chamber prior to and/or upon attainment of the opening rotation angle is increased in relation to the suction pressure of the screw spindle pump, which prevails in the region of the respective fluid inlet, by at most 20% or by at most 10% of a difference in pressure between the suction pressure and the pressure in the region of the fluid outlet.

9. The screw spindle pump according to claim 8, wherein the inner diameter of the screw profile of the drive spindle or of at least one of the drive spindles and/or of the running spindle or of at least one of the running spindles is less than 0.7 times the outer diameter of the respective screw profile.

10. The screw spindle pump according to claim 8, wherein the mean circumferential gap between the outer edge of the screw profile of the drive spindle or of at least one of the drive spindles and/or of the running spindle or of at least one of the running spindles and the housing is less than 0.002 times the outer diameter of the respective screw profile.

* * * * *